US010532602B2

(12) United States Patent
Niemeyer et al.

(10) Patent No.: US 10,532,602 B2
(45) Date of Patent: Jan. 14, 2020

(54) WRITING INSTRUMENT WITH RESETTING OPERATING UNIT

(71) Applicant: MONTBLANC-SIMPLO GMBH, Hamburg (DE)

(72) Inventors: Stefan Niemeyer, Stelle (DE); Hendrik Sassenberg, Hamburg (DE)

(73) Assignee: MONTBLANC-SIMPLO GMBH, Hamburg (DE)

( * ) Notice: Subject to any disclaimer, the term of this patent is extended or adjusted under 35 U.S.C. 154(b) by 46 days.

(21) Appl. No.: 15/747,718

(22) PCT Filed: Jul. 28, 2016

(86) PCT No.: PCT/EP2016/068020
§ 371 (c)(1),
(2) Date: Jan. 25, 2018

(87) PCT Pub. No.: WO2017/017195
PCT Pub. Date: Feb. 2, 2017

(65) Prior Publication Data

US 2018/0215194 A1 Aug. 2, 2018

(30) Foreign Application Priority Data

Jul. 28, 2015 (DE) ..... 10 2015 009 814

(51) Int. Cl.
*B43K 24/06* (2006.01)
*B43K 7/12* (2006.01)
(Continued)

(52) U.S. Cl.
CPC ..... *B43K 24/06* (2013.01); *B43K 7/12* (2013.01); *B43K 23/128* (2013.01); *B43K 7/005* (2013.01)

(58) Field of Classification Search
CPC ..... B43K 24/00; B43K 24/02; B43K 24/06
(Continued)

(56) References Cited

U.S. PATENT DOCUMENTS

2012/0153541 A1 6/2012 Rolion

FOREIGN PATENT DOCUMENTS

EP 0231521 A1 8/1987
EP 0496944 A1 8/1992
(Continued)

OTHER PUBLICATIONS

International Bureau of WIPO, International Search Report in Application No. PCT/EP2016/068020, dated Nov. 4, 2016.
(Continued)

*Primary Examiner* — David J Walczak
*Assistant Examiner* — Joshua R Wiljanen
(74) *Attorney, Agent, or Firm* — LKGlobal | Lorenz & Kopf, LLP

(57) ABSTRACT

A writing implement includes a housing for receiving a refill, an operating side and a writing side. An adjustment mechanism in the housing has a guide bushing and a cam pin concentrically arranged therein and spring-loaded along the longitudinal axis on the refill, which cam pin engages an end of the refill. The cam pin has at least two locking positions, which are offset along the longitudinal axis. The writing implement includes a control arrangement having a resetting device, a freewheel couplable with an operating unit arranged at the operating side and a cam bushing couplable with the freewheel. The resetting device exerts a resetting force onto the operating unit. The freewheel is a rotatably supported body having a circumferential recess and forms an operative connection in a region with a second body that is rotatably supported and concentrically thereto. One of the first and second rotatably supported bodies is freely rotatable
(Continued)

around its longitudinal axis in an angle range and transfers a rotation from the operating unit to the cam bushing outside of this range.

15 Claims, 9 Drawing Sheets

(51) Int. Cl.
*B43K 23/12* (2006.01)
*B43K 7/00* (2006.01)

(58) Field of Classification Search
USPC ..... 401/99, 109
See application file for complete search history.

(56) References Cited

FOREIGN PATENT DOCUMENTS

| | | | |
|---|---|---|---|
| JP | H07237394 | A | 9/1995 |
| WO | 2014046227 | A1 | 3/2014 |

OTHER PUBLICATIONS

International Bureau of WIPO, Written Opinion of the International Searching Authority in Application No. PCT/EP2016/068020, dated Feb. 2, 2017.

WRITING INSTRUMENT WITH RESETTING OPERATING UNIT

CROSS-REFERENCE TO RELATED APPLICATION

This application is a U.S. National-Stage entry under 35 U.S.C. § 371 based on International Application No. PCT/EP2016/068020 filed Jul. 28, 2016 which was published under PCT Article 21, and which claims priority to German Patent Application No. 102015009814.4, filed Jul. 28, 2015, which are all hereby incorporated in their entirety by reference.

TECHNICAL FIELD

This application pertains to a writing implement and in particular a ball pen according to the preamble of claim 1.

BACKGROUND

Usually, ball pens include a housing, a writing means that is spring-loaded therein, e.g. a ball pen refill or a high-capacity refill, and an adjustment mechanism. At an operating side ball pens comprise an operating unit, wherein the ball pen may either operated by a push button arranged at the operating unit or through rotating the operating unit itself. In the case of a rotating operating unit it usually locks in a first or a second operating position after manipulating it, depending on the direction of rotation. In doing so, in the first operating position the ball pen refill is in a pushed-forward writing position, such that the tip of the writing means reaches out of the housing. In a second operating position the writing means is retracted into the housing in a storing position, in which the writing means is fully received by the housing. Ball pens of this type are elaborately described in the prior art.

For example, U.S. Pat. No. 2,624,314 describes a ball pen having a retractable ball pen refill, which can be manipulated through an operating button. When the operating button is pressed down, an adjustment mechanism locks, such that the tip of a writing means projects out of the housing. A repeated pressing down releases the locking of the adjustment mechanism and the writing means is pushed back into a retracted storing position through a spring.

Patent publication DE 103 32 844 describes a manual writing implement, which comprises both a writing refill as well as an input pen. Through rotation of a rear housing element a displacement mechanism is operated, which pushes a writing refill forward in an axial direction, while at the same time an input pen is moved into a retracted storing position. Through rotation of the rear housing element into an opposite direction the input pen is pushed forward in the axial direction, while at the same time the writing refill is moved into a retracted storing position. For this, a cam pin for moving the writing refill and a further cam pin for moving the input pen are mechanically connected to a cam bushing having slot-shaped guiding cams. The slot-shaped guiding cams of the cam bushing are arranged one upon the other and thereby run in a helical shape in opposite directions to each other. Between a first and a second operating position both the input pen and the writing refill are in a storing position retracted in the housing.

At the writing instruments disclosed in the prior art the operating unit at a rear end of the housing in each case remains in the operating position to which it was switched. This may be disadvantageous, in particular with precious writing implements with prints on the housing, high-grade ornaments or elaborate engravings, since through locking the housing halves that are rotated relative to each other in an operating position, the patterns on the writing implement are not coherent any more, which may change the general appearance of the writing implement in an adverse manner. In addition, other objects, desirable features and characteristics will become apparent from the subsequent summary and detailed description, and the appended claims, taken in conjunction with the accompanying drawings and this background.

SUMMARY

It may therefore be considered an object of the disclosure to propose a writing implement, at which a coherent, outer appearance is achieved.

This object is met by a writing implement having the features of independent claim 1. Advantageous embodiments and further improvements can be gathered from the sub claims and the following description.

It is proposed a writing implement, comprising a housing for receiving a writing refill along a longitudinal axis, an operating side and a writing side, an adjustment mechanism supported in the housing, having a guide bushing and a cam pin concentrically arranged therein and spring-loaded along the longitudinal axis on the writing refill, which cam pin is engageable with an end of the writing refill, wherein the cam pin is bringable into at least two locking positions, which are offset along the longitudinal axis. The writing implement further comprises a control arrangement having a resetting device, a freewheel couplable with an operating unit arranged at the operating side and a cam bushing coupled with the freewheel. The cam bushing comprises a gliding surface curved at one side for a contacting surface of the cam pin. The contacting surface may be designed in the form of a protrusion. The resetting device exerts a resetting force onto the operating unit. The freewheel is a first rotatably supported body having a circumferential recess and forms an operative connection at least in a region with a second body that is rotatably supported and concentrically thereto. One of the first rotatably supported body and the second rotatably supported body is freely rotatable around its longitudinal axis in a first angle range and transfers a rotation from the operating unit to the cam bushing outside of this first angle range.

Hence, the writing implement differs from known writing implements and in particular from ball pens having a rotation mechanism through the control arrangement, which comprises the resetting device, the freewheel and the cam bushing. By the control arrangement it is possible to bring the operating unit after manipulating and locking the writing refill back into a neutral position, without changing the adjusted position of the writing refill. Through the resetting device a resetting force acts upon the operating unit, which resetting force resets the operating unit into its original position after manipulating it.

The cam bushing is a device, which transforms a rotating motion initiated by the operating unit into an axial motion. The cam bushing may thereby move the cam pin and, consequently, the writing refill in an axial direction, wherein the cam pin comprises at least one contacting surface, preferably in the form of a protrusion, which is guided at the gliding surface.

The cam bushing preferably comprises a helix-type shape having locking recesses offset from each other in an axial direction, which are connected to each other through a gliding surface curved on one side. The locking recesses are adapted for receiving a protrusion of the cam pin, which is guided along the gliding surfaces.

Through the shape of the locking recesses, which is arched and semicircular opposite to the writing side, a protrusion that has entered a locking recess can only exit the locking position through overcoming a force acting upon the writing refill given by the shape of the locking recess and the gliding surfaces, respectively, and of the resistance determined by the resetting force, through rotation of the cam bushing. A force that acts upon the writing refill and, consequently, upon the cam pin, in the direction of the operating side cannot move the writing refill to the operating side.

The freewheel may selectively allow or prevent a transfer of torque between the operating unit and the cam bushing. Thereby it is simultaneously prevented to move the writing refill from its extended or retracted position into the respective other position, if the operating unit is rotated back into a neutral position. The implementation of the freewheel is preferably accomplished in a way that a reliable transfer of torque is conducted but that also a high resetting precision of the operating unit is achieved at the same time.

Preferably, the freewheel has an elongate, cylindrical shape having a recess, which extends about a part of the circumferential surface. The recess may thereby be shaped differently and may extend over the complete longitudinal axis of the freewheel or merely in one or multiple subsections of the freewheel.

Preferably, the recess of the freewheel is capable of receiving a second body, which is concentrical thereto and rotatably supported. It preferably comprises an elongate, web-like protrusion having at least one first contacting surface and a second contacting surface and is integrated into the inner housing side of the operating unit. At a rotational motion of the second rotatably supported body exceeding the angle range of the recess of the freewheel, the freewheel will be entrained by the protrusion of the second rotatably supported body through a surface contact between the recess and the second contacting surface of the protrusion of the second boy and rotated with it about the longitudinal axis. Within the angle range of the recess of the freewheel the second rotatably supported body is freely rotatable.

In a further embodiment the second rotatably supported body may comprise other shapes, such as the shape of a short, compact protrusion. Furthermore, in a further embodiment the recess may be integrated into the inner side of the housing of the operating unit and the freewheel may comprise a protruding body instead of a recess, preferably in the form of a protrusion or a web, and is resultantly based on a kinematic inversion.

Due to the resetting device of the writing implement, the position of the operating unit is always independent of the locking position of the writing implement, such that ornaments, which are possibly arranged on the outer side of the housing of the writing implement and, resultantly, the overall appearance of the writing implement are not disturbed.

In a further embodiment of the writing implement the resetting device comprises a spring mechanism, at which a spring force acts upon the operating unit and resets it into an original base or ground position. The resetting force may be realized by leaf springs, coil springs, magnets, rubber elements or similar. The forces resulting from the spring mechanism may hereby act both in a parallel direction to the longitudinal axis and a transverse thereto.

According to a further embodiment the resetting device comprises a cam bushing and a second body that is rotatable concentrically thereto, which rotate the operating unit after a manipulation back into a neutral position. The cam bushing or the second concentrically rotatable body is spring-loaded. The second body concentrically rotatable may inter alia be realized as a separate protrusion. A further option is a combination of the freewheel's concentrically rotatably supported second body and the resetting device's concentrically rotatably supported second body in the form of a mutual, elongate or web-shaped body having a first and a second contacting surface. It may be integrated fixedly at the inner side of the housing of the operating unit e.g. by gluing, welding, under using of plug connections or similar or may constitute a part of the housing itself. Furthermore, the cam bushing or the protrusion may be spring-loaded. This enables the installation of the resetting device either into the housing or into the operating unit. Preferably, the operating unit is realized in the form of a cap or a component similar to a cap that is not detachable, which is arranged at the operating side of the writing implement.

In a further embodiment of the writing implement the cam bushing is integrated into the housing in a rotation-proof manner and movable along the longitudinal axis. By this, a force that acts parallel to the longitudinal axis is directed to the operating unit, preferably in the form of the second concentrically rotatable body, through inclined planes at both sides of the cam bushing, and generates an axially acting force. Exemplarily, the cam bushing may comprise a protrusion, which can be arranged in a preferably elongate recess in the form of a slot and which is movable in it in a direction along the longitudinal axis. A rotational motion of the cam bushing can thereby be prevented. The cam bushing may inversely comprise a recess with an elongate shape, in which a body is arrangeable that is movable along a longitudinal axis. The rotationally fixed cam bushing allows a particularly compact design of the writing implement.

According to a further embodiment the guide bushing comprises a first gliding surface in the form of a recess, exemplarily in the shape of a first slot, and the cam bushing comprises a protrusion that is shaped so as to correspond with the recess. By this, the guide bushing creates a glide rail along the longitudinal axis, with which the protrusion of the cam bushing engages and along which the cam bushing can glide. This allows the cam bushing to glide along the guide bushing in a rotation proof manner, such that an interference-free force transfer is accomplished.

In a further embodiment the guide bushing comprises a second gliding surface in the form of a second recess, for example in the shape of a second slot, for receiving a protrusion of the cam pin. The cam pin is arranged in a rotation-proof manner in the housing, but movable in the direction of the longitudinal axis by the second recess and the protrusion that is movably supported in the direction of a longitudinal axis therein. The first and second recess of the guide bushing may either independently or combined be a component of the guide bushing; however, they do not have to be compulsorily integrated into the guide bushing.

In a further embodiment the cam bushing comprises a glide surface for a first contacting surface of the second concentrically rotatable body, which is preferably of an elongate shape. Preferably, the second concentrically rotatable body is realized in the form of a web, which is integrated into the operating unit, in particular a cap or a component similar thereto. The web may be designed in such a manner that it assumes an operative connection in the form of a linear or surface contact both with the cam bushing and with the free wheel. Furthermore, it may also be possible to design the protrusions as individual, protruding bodies. The gliding surface of the cam bushing may be shaped straight, curved or the such depending on the requirement. This allows an individual and/or particularly space saving option for a force transfer.

According to a further embodiment the cam bushing comprises two sloped planes that run towards each other. The sloped planes may thereby comprise the same length or different lengths. In running towards each other they create a lowest common point, which at the same time corresponds to the neutral position of the writing implement. The cam bushing is shaped straightly on the sie opposed to the sloped plane and is thus suitable as a contacting surface for a spring mechanism. By the spring force that acts onto the underside of the cam bushing, a force is transferred onto the gliding surfaces of the cam bushing, which in turn is transferred onto the second rotatably supported body and urges it into the lowest common point of the sloped planes of the cam bushing, i.e. into the neutral position of the writing implement.

In a further embodiment the first rotatably supported body of the freewheel having the circumferential recess comprises a rotation-proof connection with the cam bushing. For this, the cam bushing comprises a detent on an outer surface at a side of the cam bushing opposite to the gliding surfaces. The first rotatably supported body of the freewheel comprises a corresponding detent at the inner side. By gluing, welding or locking in place of the cam bushing with the first body of the freewheel, a force that act onto the freewheel is transferable onto the cam bushing and vice versa.

In a further embodiment the rotatably supported body of the freewheel having the circumferential recess comprises an elastic connection with the cam bushing. The cam bushing and the rotatably supported body of the freewheel are thereby connected through an elastic component, preferably made from a flexible or rubber-like material such as elastomers. Due to the slightly elastic connection of the rotatably supported body of the freewheel and the cam bushing the force transfer during a rotation of the operating element is somewhat delayed, such that a slight resistance is perceptible for a user before activation of the writing implement.

According to a further embodiment the rotatably supported body of the freewheel comprises a protruding second contacting surface and the second rotatably supported body comprises a corresponding recess. The protruding second contacting surface of the freewheel and the recess of the second rotatably supported body correspond to each other, such that both components form an operative connection, if the protruding second contacting surface is rotated so far to exceed the angle range of the recess.

According to a further embodiment the second contacting surface of the second rotatably supported body comprises the shape of a web at the inner side of the operating unit. The second rotatably supported body corresponds to the recess of the rotatably supported body of the freewheel. In a further embodiment the second body, which is realized with a web shape, serves for a transfer of force onto the gliding surface of the cam bushing.

According to a further embodiment, the neutral position of the operating unit is arranged in the angle range of the recess of the freewheel. The second rotatably supported body may be freely rotation in the angle range of the recess of the freewheel, without influencing the control arrangement or the resetting device. During a rotation to exceed the angle range a force transfer onto the control arrangement and the resetting device is conducted.

In a further embodiment the operating unit is created in the form or a rotating element, an actuation button, a rocker or a slider. The different actuation alternatives may thereby be versatile. The various actuation variations may be reseted after actuating the writing implement into an original neutral position through the writing implement according to the invention.

According to a further embodiment, the control arrangement having the resetting device is received by the operating unit at the inner side. This allows to realize a particularly compact arrangement of components and allows an appealing design of the writing implement.

BRIEF DESCRIPTION OF THE DRAWINGS

Embodiments of the present invention will hereinafter be described in conjunction with the following drawing figures, wherein like numerals denote like elements, and.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

Figure 1:
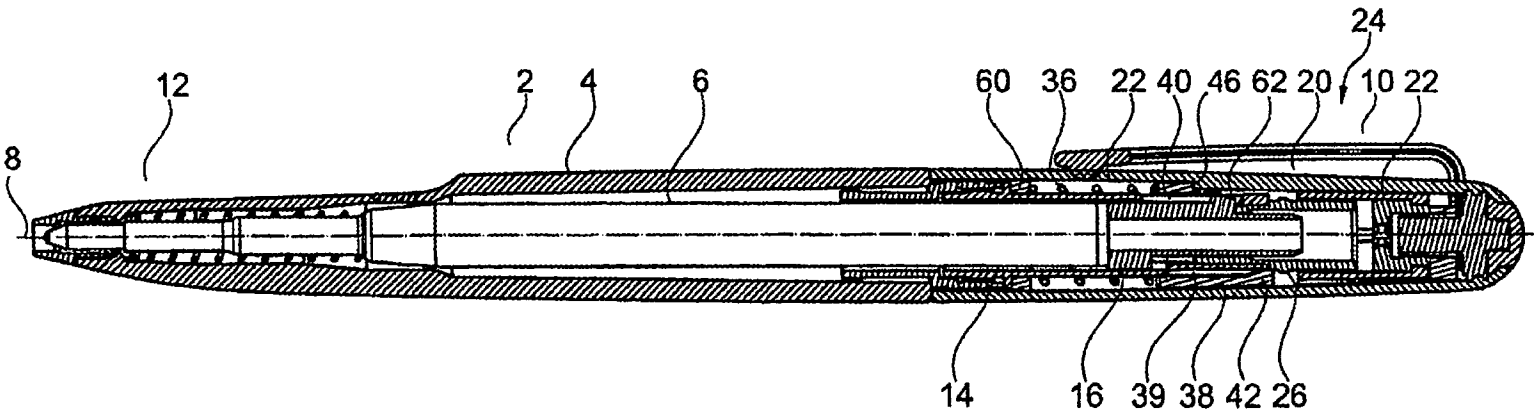
FIG. 1 shows an overview of an exemplary embodiment of the components of the inner setup of the writing implement according to the invention in a cross-sectional view.

FIG. 1 shows an overview of an exemplary embodiment of a writing implement according to the invention, whose function is explained step by step in the following figures. In FIG. 1 also an overview of the inner setup of the whole writing implement 2 is shown.

The writing implement 2 comprises a one-piece or multipart housing 4, into which a writing refill 6 is arranged along a longitudinal axis 8. The writing implement 2 comprises an operating side 10 and a writing side 12. A spring-loaded writing refill 6 is arranged in a hollow space of the housing 4. An operating unit 24 is present at the operating side 10 of the writing implement 2. A cam pin 16 is arranged in the operating unit 24, which cam pin is suitable for receiving the writing refill 6 and for latching into multiple locking recesses. The cam pin 16, the cam bushing 26 and the writing refill 6 together are partially enclosed by a guide bushing 14, around which a spring mechanism 36 is arranged. The spring mechanism 36 exerts a force onto a cam bushing 38, which surrounds the cam pin 16, the cam bushing 26 and the guide bushing 14.

The guide bushing 14 comprises a first gliding surface 39 in the form of a recess, which is exemplarily realized as a slot, which recess receives a correspondingly shaped protrusion 42 of the cam bushing 38. Consequently, the cam bushing is rotation-proof, but is supported to be movable in a direction along a longitudinal axis in the operating unit 24. Furthermore, the cam bushing 14 comprises a second gliding surface 40 in the form of a recess, which is exemplarily shaped as a slot, which receives a protrusion 62 of the cam pin 16 and thereby prevents a possible rotation of the cam pin 16, but allows a movement of the cam pin in a direction along a longitudinal axis. A circumferential, sloped plane of the cam bushing 38 borders on a protruding body 32 of an elongate shape, which is integrated into the operating unit 24. Additionally, in a preferred embodiment the protruding elongate body 32 borders on a body of a freewheel 22, which body is supported concentrically to the longitudinal axis 8 that comprises a recess, which extends over a first angle range.

Figure 2:
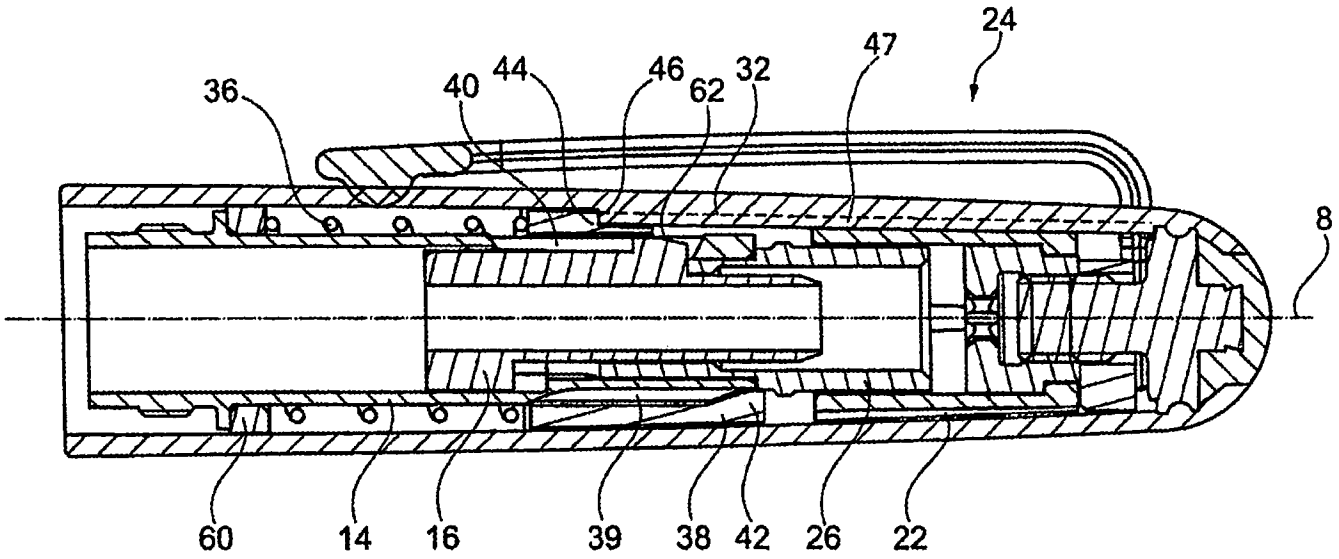
FIG. 2 shows an exemplary embodiment of an arrangement of a control unit having a resetting device in an operating unit of the writing implement according to the invention.

FIG. 2 shows an enlarged detail view of an arrangement inside an operating unit 24 according to an embodiment of the invention. At its outer side, the guide bushing 14 comprises a gliding ring 60, which abuts against the spring mechanism 36. Furthermore, the guide bushing 14 comprises a first gliding surface 39, preferably in the form of a rail-like, elongated recess in the shape of a first slot. Corresponding thereto, the cam bushing 38 comprises a recess 42 in the form of a driver cam, which is movable in the gliding surface 39 of the guide bushing 14 in the direction of the longitudinal axis 8 of the writing implement 2. Furthermore, the guide bushing 14 comprises a second gliding surface 40, preferably in the form of a second recess in the shape of a second slot. The second slot is capable of receiving a protrusion 62 of the cam pin 16 and thus prevents a rotation of the cam pin 16, wherein the protrusion 62 is movable in a direction along a longitudinal axis in the second gliding surface 40.

The cam bushing 38 comprises a two-sided, sloped plane 48, 50, which serves as a gliding surface for a first contacting surface 46 of the second body 32, which is supported so as to be rotatable relative to the cam bushing 38 and which is integrated into the operating unit. The second body 32, which is rotatably supported relative to the longitudinal axis 8 and which has a first contacting surface 46 and a second contacting surface 47, is freely rotatable in the first angle range of the first rotatably supported body of the freewheel 22, which first angle range is limited by a recess. A rotational motion of the operating unit 24 exceeding the angle range of the recess 30 of the freewheel leads to entraining the freewheel 22 and thus to a rotation of the cam bushing 26, such that the protrusion 62 of the cam pin 16 enters different locking recesses 56, 58 of the cam bushing 26 through gliding surfaces 28. By this, a movement of the cam pin 16 along the longitudinal axis 8 of the writing implement 2 results, which transfers onto the writing refill 6. Hereby, the cam pin 16 in a slot is secured against a rotation through its protrusion 62 in the guiding bushing 14 (see FIG. 4).

The rotation of the operating unit 24 may be conducted bidirectionally, wherein a rotation in a first direction pushes the writing refill 6 out of the housing 4 and locks it in an operating position, and the rotation in a second direction releases the locking and places the writing refill 6 in a storage position in the housing 2. A neutral position of the operating unit 24, in which the control arrangement is neither locked nor unlocked, is preferably located centrally between a position of the operating unit 24, in which a locking of the writing refill 6 is conducted, and a position of the operating unit 24, in which the locking of the writing refill 6 is released. In a further embodiment the neutral position may also be placed in another circumferential position.

Figure 3:
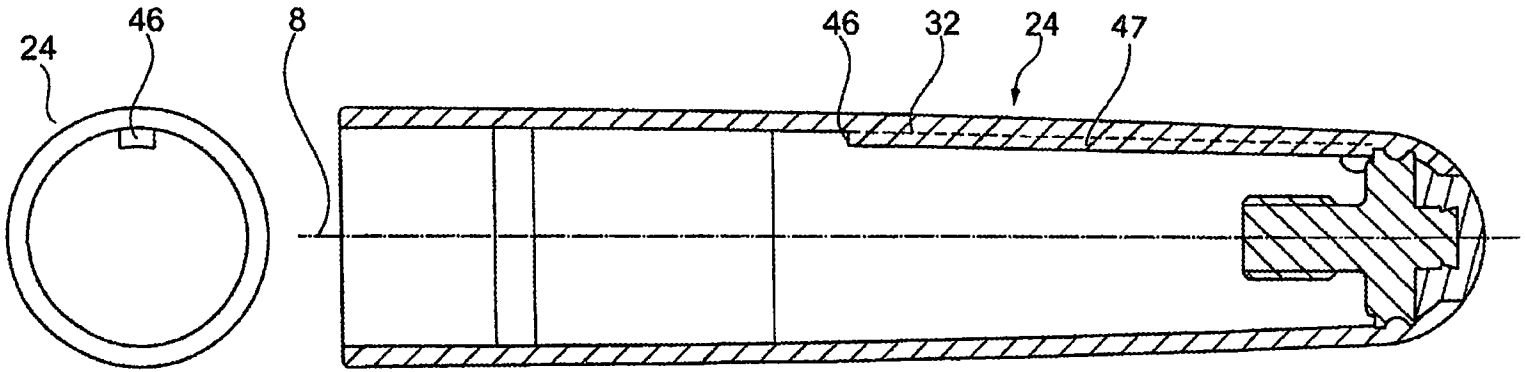
FIG. 3 show an exemplary embodiment of an elongate body arranged in the operating unit according to the invention.

FIG. 3 shows a detail view of an exemplary embodiment of an arrangement in a housing of an operating unit 24. A body 32 having an elongate shape having an elongated, second contacting surface 47, is arranged in a part of the housing 4 along the longitudinal axis 8, through which body 32 the body of the freewheel 22 arranged in the operating unit 24 and supported to be rotatable around the longitudinal axis can be moved. At the same time, a short first contacting surface 46 of the elongate body 32 inside the operating unit is guided along gliding surfaces 44 of the spring-loaded cam bushing 38 (see FIG. 2 and FIG. 9) during the rotation of the operating unit 24.

Figure 4:
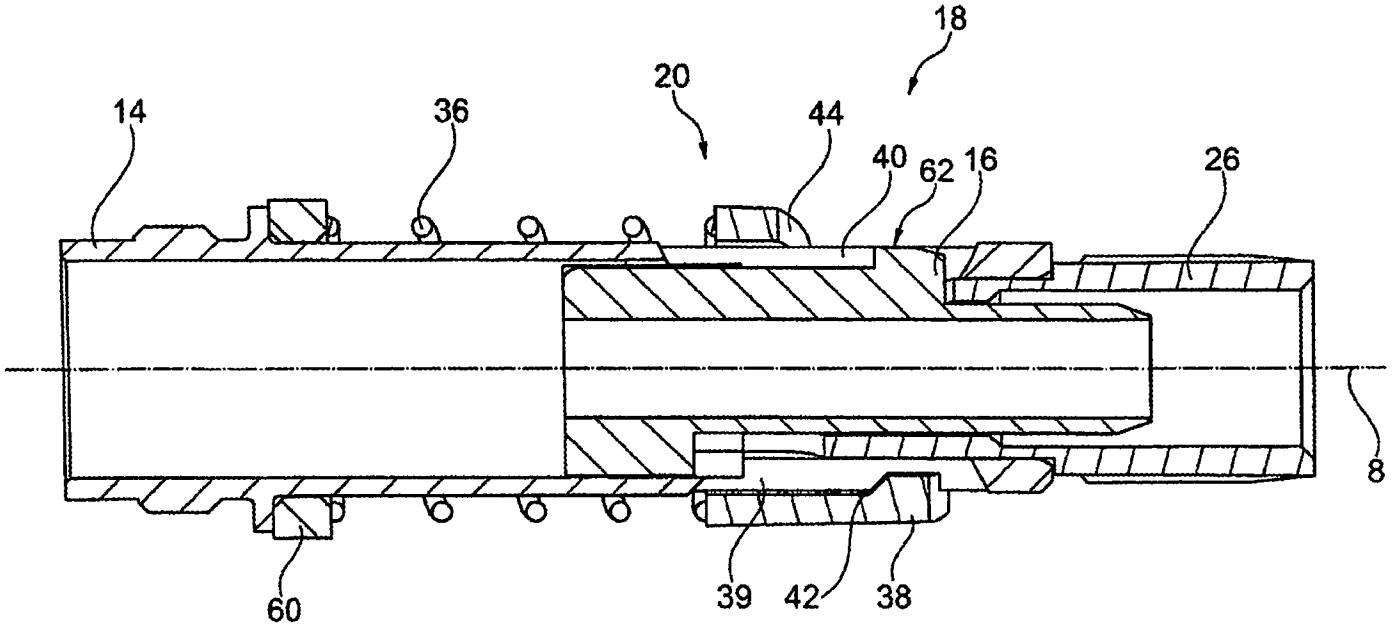
FIG. 4 shows an enlarged view of an exemplary embodiment of a control arrangement having a resetting device in a cross-sectional view.

FIG. 4 shows an enlarged detail view of an exemplary embodiment of a control arrangement 18 having a resetting device 20. By rotating the cam bushing 26 a protrusion 62 of the cam pin 16 glides on a single-sided gliding surface into different locking recesses 56, 58 of the cam bushing 26, preferably in the form of semi-circular recesses. The locking recesses 56, 58 of the cam bushing 26 are offset along the longitudinal axis 8 of the writing implement and resultantly lead to a displacement of the cam pin 16 along the longitudinal axis on actuation of the operating unit 24.

The cam pin 16 and the cam bushing 26 are partially enclosed by the guide bushing 14, which comprises an elongate first gliding surface 39, preferably in the form of a rail-like, elongated slot, in the position of the overlap of cam pin 16 and cam bushing 26. The guide bushing 14 is surrounded by a spring mechanism 36 and a cam bushing 38, wherein the spring mechanism borders on a straight side of the cam bushing 38. Preferably, the latter comprises a protrusion 42, which engages with the first gliding surface 39 of the guide bushing 14 and which is displaceable therein in the longitudinal direction 8. Preferably, the guide bushing comprises a second gliding surface 40 in the form of a slot, which is compatible to the protrusion 62 of the cam pin 16. Thus, on the application of a force it is prevented that the cam bushing 38 and/or the cam pin 16 are rotated, but they may still be displaced in a direction along a longitudinal axis. Thus, the spring-loaded cam bushing 38 is arranged in the operating unit 24 in a rotation-proof manner. A force acting onto the gliding surface 44 of the cam bushing 38, exemplarily emanating from an elongated, web-like body 32 fixedly arranged in the operating unit 24 based on the first contacting surface 46, therefore causes the cam bushing 38 to move away in the direction of the longitudinal axis.

Figure 5:
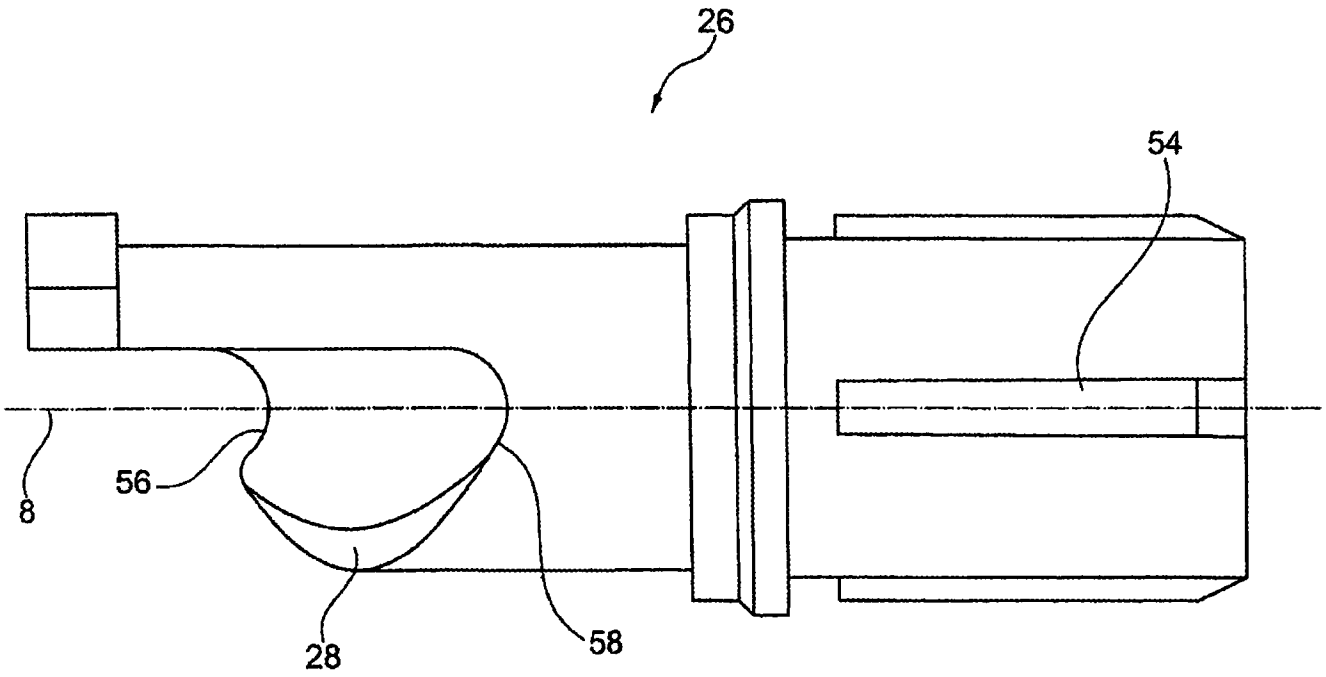
FIG. 5 shows an exemplary embodiment of a cam bushing.

FIG. 5 shows an exemplary embodiment of a cam bushing 26. Preferably, the cam bushing 26 comprises multiple semicircular recesses 56, 58, which are offset along a longitudinal axis 8. The cam bushing 26 preferably comprises a gliding surface 28, which is curved on one side, through which two or more locking recesses 56, 58 are connected, wherein the locking recesses 56, 58 are offset along a longitudinal axis and are capable of receiving a protruding body. On the opposite side, the cam bushing 26 comprises a detent 54, with which a rotation-proof connection with a detent 52 on an inner side of a first rotatably supported body of a freewheel 22 is creatable. The type of connection may be realized diversely. Different kinds of plug-in connections, gluing and soldering connections as well as rotary joints and the such are conceivable.

Figure 6:
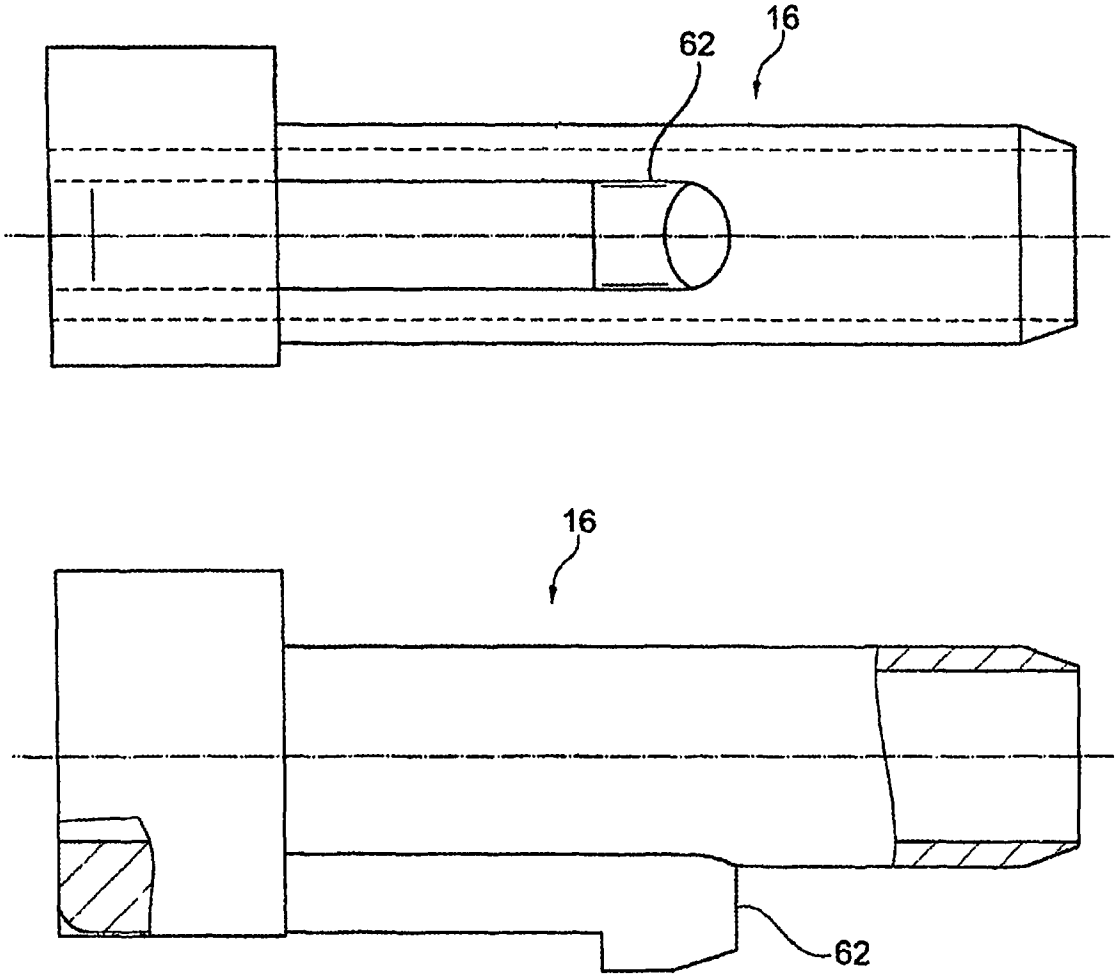
FIG. 6 shows a top view and a lateral view of an exemplary embodiment of a cam pin.

FIG. 6 shows a top view and the lateral views of a preferably elongated cam pin 16. The cam pin 16 comprises a protrusion 62, which serves as a rotation lock to the guide bushing 14. Furthermore, the protrusion 62 of the cam pin 16 is positionable in the locking recesses 56, 58. The protrusion 62 of the cam pin 16 moves along the gliding surfaces 28 of the cam bushing 26 and stays in one of the locking recesses 56, 58 of the cam bushing 26, through which the writing refill 6 may be moved to and locked in different positions along the longitudinal axis 8 of the writing implement 2.

Figure 7:
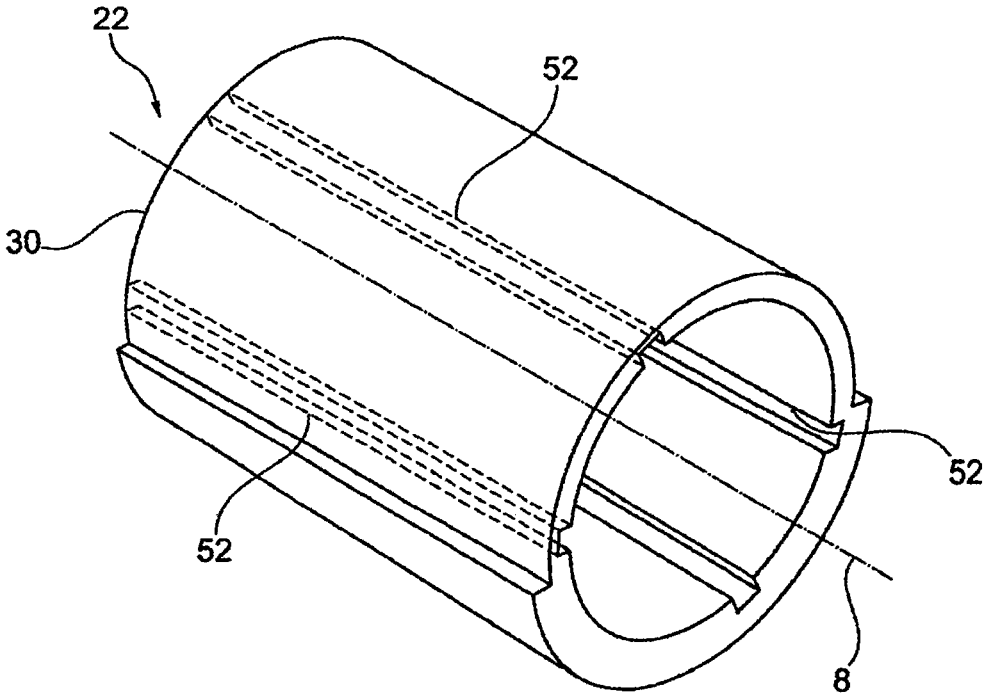
FIG. 7 shows a view of an exemplary embodiment of a first rotatably supported body of the freewheel having a circumferential recess.

FIG. 7 shows a first body 22 of a freewheel, which body is supported rotatably around its longitudinal axis 8 and has a circumferential recess 30. At the inner side the body 22 comprises a detent 52, which is compatible to the detent 54 of the cam bushing 26. They engage in a rotation-proof connection together. In this regard, this may be a screwing, a plugging, a gluing or a soldering connection or the such.

The circumferential recess 30 comprises a first angle range of exemplarily 180° around the longitudinal axis of the body 22. The second body 32, which is rotatably supported around the longitudinal axis 8 of the writing implement 2 and arranged at an inner side of the housing 4 of the operating unit 24, is positionable in the circumferential recesses of the first body 22. With a rotation exceeding the angle range of preferably about 90° of the circumferential recess 30, the first rotatably supported, cylinder-shaped body 22 having a circumferential recess 30 is caused to rotate by the second, web-like body 32.

Figure 8:
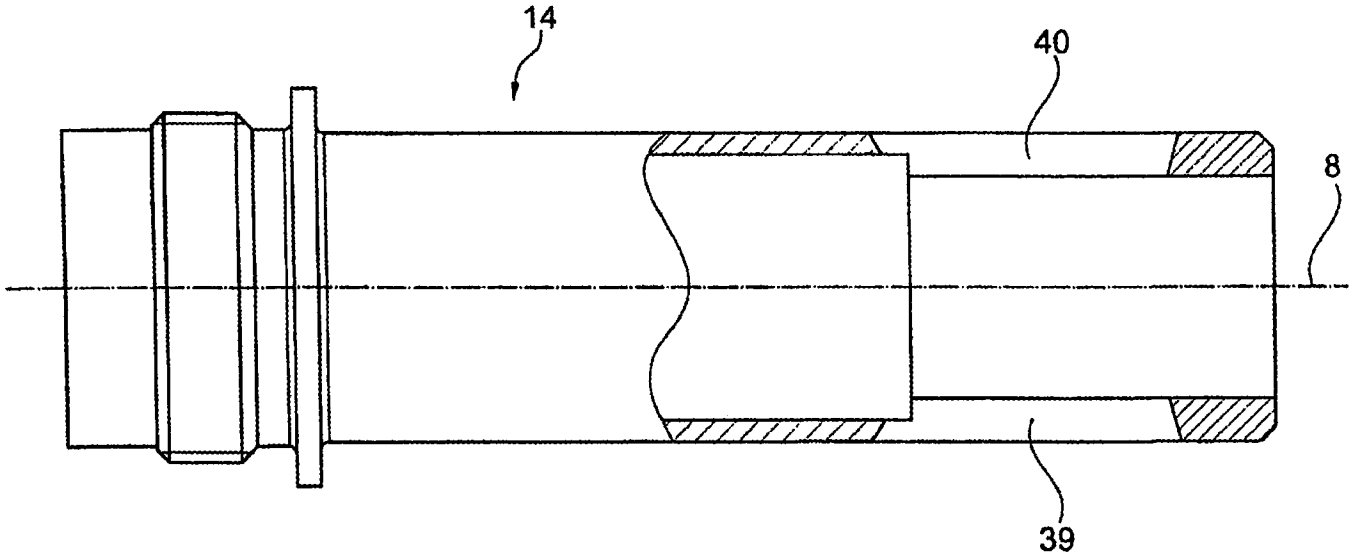
FIG. 8 shows a partial cross section of an exemplary embodiment of a guide bushing.

FIG. 8 shows an exemplary embodiment in a partial cross section of an elongate, tube-like guide bushing 14. It comprises two gliding surfaces 39 and 40, which run along the longitudinal direction 8 of the writing implement 2 and are offset about 180° to each other, preferably in the form of a rail-like recess or a slot, which are suitable for receiving a protrusion 42 of a cam bushing 38, as well as a protrusion 62 of a cam pin 16. Preferably, the guide bushing 14 comprises a circumferentially arranged gliding ring 60, which serves for delimiting a spring mechanism 36 and which preferably encloses the guide bushing 14.

Figure 9:
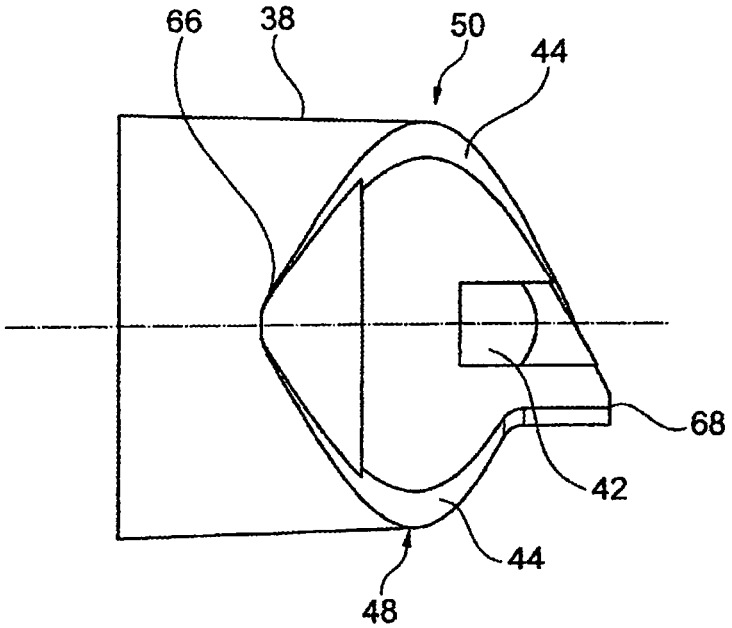
FIG. 9 shows a lateral view as well as a cross section of an exemplary embodiment of a cam bushing according to the invention.
Figure 9:
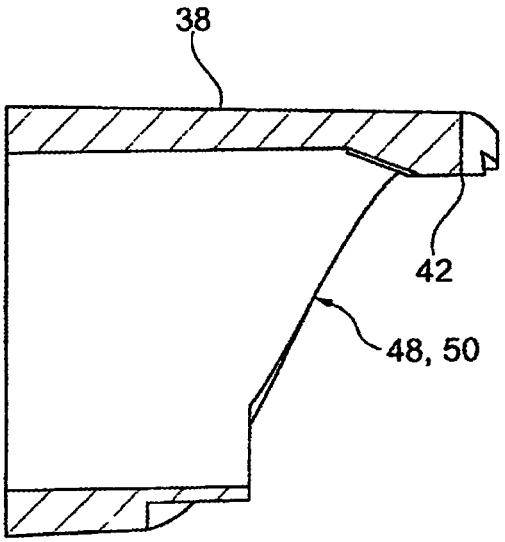

FIG. 9 discloses a lateral view as well as a cross-section of a cam bushing 38 having a sloped plane 48, 50 that runs along both sides. The sloped plane 48, 50 serves as a gliding surface for the first contacting surface 46 at the end of the elongated body 32 that is integrated into the housing of the operating unit 24. Both sloped planes that run onto each other create a common lowermost point 66, which corresponds to the neutral position of the operating unit 24 of the writing implement 2, which neutral position is preferably in a center between the locking position and the release position of the writing refill 6. At a highest point 68 of a sloped plane 48, 50 the cam bushing 38 preferably comprises a protrusion 42, which corresponds to the first gliding surface 39 (see FIG. 2) in the guide bushing 14, such that the cam bushing 38 is integrated in the operating unit 24 in a rotation-proof manner. Opposite the curved side, the cam bushing 38 is preferably of a flat shape and capable of being supported by a spring mechanism 36. By the rotation-proof arrangement of the cam bushing 38 in the operating unit 24, it moves away towards the spring mechanism 36 against the spring force if a force is exerted onto the gliding surfaces 44 of the cam bushing 38 or through a first contacting surface 46 of the second body 32 that is supported rotatably around the longitudinal axis 8 at the inner side of the housing 4 of the operating unit 24. If the force that acts onto the gliding surface 44 of the cam bushing 38 decreases, the second rotatably supported body 32 with the first contacting surface 46 is displaced along the glide surfaces 44 into the common lowermost point 66 of the sloped planes 48, 50 that run onto each other, which also corresponds to a neutral position of the operating unit 24 of the writing implement 2.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A writing implement, comprising:

a housing configured to receive a writing refill along a longitudinal axis, an operating side and a writing side, wherein an adjustment mechanism supported in the housing, having a guide bushing and a cam pin concentrically arranged therein and spring-loaded along the longitudinal axis on the writing refill, which cam pin is engageable with an end of the writing refill, wherein the cam pin is bringable into at least two locking positions, which are offset along the longitudinal axis, and a control arrangement having a resetting device, a freewheel couplable with an operating unit arranged at the operating side and a first cam bushing coupled with the freewheel, wherein the first cam bushing comprises a gliding surface curved at one side for a contacting surface of the cam pin, wherein the resetting device exerts a resetting force onto the operating unit, wherein the freewheel is a first rotatably supported body having a circumferential recess and forms an operative connection at least in a region with a second rotatably supported body, the first rotatably supported body and the second rotatably supported body being concentrically rotatable about the longitudinal axis, and wherein one of the first rotatably supported body and the second rotatably supported body is freely rotatable around its longitudinal axis in a first angle range and transfers a rotation from the operating unit to the first cam bushing outside of this first angle range.

2. The writing implement according to claim 1, wherein the resetting device comprises a spring mechanism.

3. The writing implement according to claim 1, wherein the resetting device comprises a second cam bushing that is rotatable concentrically to the second rotatably supported body, which rotate the operating unit after a manipulation back into a neutral position, and wherein the second cam bushing or the second rotatably supported body is spring-loaded.

4. The writing implement according to claim 3, wherein the second cam bushing is integrated into the housing in a rotation-proof manner and movable along the longitudinal axis.

5. The writing implement according to claim 3, wherein the guide bushing comprises a first gliding surface in the form of a recess and wherein the second cam bushing comprises a protrusion that is shaped so as to correspond with the recess.

6. The writing implement according to claim 3, wherein the second cam bushing comprises a glide surface for a first contacting surface of the second body that is supported concentrically rotatable thereto.

7. The writing implement according to claim 3, wherein the second cam bushing comprises two sloped planes that run towards each other.

8. The writing implement according to claim 1, wherein the guide bushing comprises a second gliding surface in the form of a recess for receiving a protrusion of the cam pin.

9. The writing implement according to claim 1, wherein the freewheel comprises a rotation-proof connection with the first cam bushing.

10. The writing implement according to claim 1, wherein the freewheel comprises an elastic connection with the first cam bushing.

11. The writing implement according to claim 1, wherein the second rotatably supported body comprises a protruding contacting surface.

12. The writing implement according to claim 11, wherein the protruding contacting surface of the second rotatably supported body comprises the shape of a web at the inner side of the operating unit.

13. The writing implement according to claim 1, wherein a neutral position of the operating unit is arranged in an angle range of the recess of the freewheel.

14. The writing implement according to claim 1, wherein the operating unit comprises a rotating element, an actuation button, a rocker or a slider.

15. The writing implement according to claim 1, wherein the control arrangement having the resetting device is received by the operating unit at the inner side.

* * * * *